US006392682B2

(12) United States Patent
Ozawa

(10) Patent No.: US 6,392,682 B2
(45) Date of Patent: May 21, 2002

(54) PRINTER DEVICE

(75) Inventor: Atsushi Ozawa, Fussa (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/779,934

(22) Filed: Feb. 8, 2001

(30) Foreign Application Priority Data

Mar. 14, 2000 (JP) ..... 2000-069920

(51) Int. Cl.[7] ..... B41J 29/377; B41J 25/304
(52) U.S. Cl. ..... 347/223; 347/197
(58) Field of Search ..... 347/223, 197; 400/120.16

(56) References Cited

FOREIGN PATENT DOCUMENTS

| | | |
|---|---|---|
| JP | 5-112022 | 5/1993 |
| JP | 6-047991 | 2/1994 |
| JP | 6-255141 | 9/1994 |
| JP | 8-112951 | 5/1996 |

*Primary Examiner*—Huan Tran
(74) *Attorney, Agent, or Firm*—Frishauf, Holtz, Goodman, Langer & Chick, P.C.

(57) ABSTRACT

The printer device of the present invention makes use of a thermal head to transfer ink to recording paper on a platen roller, and includes a thermal head support member, cooling means, and a support member that supports the cooling means. The thermal head support member has a support component that supports the thermal head, and a recess provided to the back side, which is the opposite side from the support component, and is movably disposed between a transfer position where the ink is transferred and a retracted position to which the thermal head support member) is retracted from the transfer position. The cooling means radiates the heat generated by the thermal head. The support member supports the cooling means such that at least part of the cooling means will enter the recess when the thermal head support member is moved to its retracted position.

15 Claims, 5 Drawing Sheets

PRINTER DEVICE

This application claims benefit of Japanese Patent Application No. 2000-69920 filed in Japan on Mar. 14, 2000, the contents of which are incorporated by this reference.

BACKGROUND OF THE INVENTION

1. Field of the Invention

The present invention relates to a printer device, and more particularly relates to a printer device having a heat radiating or cooling mechanism for the heat generating component, which helps to produce a more compact thermal transfer printer.

2. Description of the Related Art

In recent years we have seen analog or digital, moving or still image signals produced by electronic cameras, as well as image data produced by computer (hereinafter referred to merely as image signals) displayed on CRTs, liquid crystal devices, and other such monitors, and also printed out on recording paper.

A printer device that prints the image of an image signal on recording paper has an ink ribbon produced by applying a thermal transfer ink coating (either meltable or thermal dye sublimation type) to a thin film, and then the ink ribbon is laid over a platen roller along with the recording paper. The printer device feeds the superposed ink ribbon and recording paper while pressing them between the platen roller and a thermal head, during which time a current corresponding to the image signal is applied to the thermal head, which heats the head and melts or sublimates the thermal transfer ink in the ink ribbon and transfer-prints it onto the recording paper.

The thermal head of a printer device comprises a plurality of heat generating elements arranged in a line in the longitudinal direction of the recording paper, perpendicular to the conveyance direction. The ink ribbon and the recording paper are squeezed between this thermal head and the platen roller, and when the recording paper and the ink ribbon are fed between the thermal head and the platen roller, the heat generating elements are heated according to the image signal data, so that the ink in the ink ribbon is thermally transferred to the recording paper.

Recording with a thermal head involves varying the heating energy of the heat generating elements of the thermal head, and thereby varying the density of the ink coating transferred from the ink ribbon, and allowing gradation to be expressed. Accordingly, if the temperature of the thermal head goes over a certain maximum, the density of the transferred ink coating cannot be accurately controlled. Also, heat build-up in the thermal head can produce shading that leads to inconsistent density of the image transferred onto the recording paper.

In view of this, a printer device is generally provided with a cooling means for monitoring the temperature of the thermal head and keeping this temperature from rising above the temperature range at which the density of the ink coating can be accurately controlled.

Techniques pertaining to the cooling or heat-radiation of this thermal head have been disclosed in Japanese Laid-Open Patent Applications H6-255141 and H6-47991.

Japanese Laid-Open Patent Application H6-255141 discloses a technique for attaching a thermistor, for detecting the temperature of a thermal head, to the thermal head, finding the difference between a rated temperature and the temperature of the thermal head, and controlling the rotational speed of a cooling fan according to this temperature differential. As the temperature of the thermal head climbs, the speed of the cooling fan is raised to increase the amount of air blown at the thermal head. Once the detected temperature drops below the rated temperature, the cooling fan is stopped.

Japanese Laid-Open Patent Application H6-47991 discloses a technique in which a thermal conduction component for allowing the heat from the head base of a thermal head to escape through an upper cover (forming the casing) is provided between the head base and the upper cover.

In addition to these, Japanese Laid-Open Patent Application H8-112951 discloses a technique pertaining to the cooling or heat-radiation of a thermal head, in which the thermal head attachment base is attached directly to a heat-radiating upper cover, and Japanese Laid-Open Patent Application H5-112022 discloses a method in which a thermal head is fixed to a chassis and the heat is radiated through this chassis, among other proposals.

What all these disclosures have in common is that images of the desired gradation can be printed by transferring the ink coating of the ink ribbon at the optimal temperature.

However, the method for controlling a cooling fan disclosed in Japanese Laid-Open Patent Application H6-255141 requires the provision of various circuit functions for comparing with a reference temperature on the basis of a temperature signal detected by a thermistor, and controlling the rotation of the cooling fan on the basis of the difference from this reference temperature. Therefore, the circuit structure of the printer device is more complicated, and the provision of this circuit structure is also a problem in that it makes the printer device bulkier and more expensive.

With the methods discussed in Japanese Laid-Open Patent Applications H6-47991 and H8-112951, in which a thermal conduction component is provided for allowing the heat from the base of the thermal head to escape through the upper cover, or the base for attaching the thermal head is attached to the heat-radiating upper cover, a cooling fan must further be provided in case sufficient heat radiation is impossible. Accordingly, space must be left for the installation of a cooling fan in the vicinity of the thermal conduction component or the attachment base, and this is a problem in that it makes the printer device bulkier.

Furthermore, when the thermal head is fixed to the chassis and heat is radiated through this chassis, as disclosed in Japanese Laid-Open Patent Application H8-112022, the platen roller must be able to swing with respect to the thermal head, and this swing mechanism for the platen roller is complicated, which is again a problem in that it makes the printer device bulkier.

The present invention was conceived in light of the above problems encountered in the past, and it is an object thereof to provide a printer device having a heat radiating or cooling mechanism which helps to produce a more compact thermal transfer printer.

SUMMARY OF THE INVENTION

The printer device of the present invention makes use of a thermal head to transfer ink to recording paper on a platen roller, and comprises a thermal head support member, cooling means, and a support member that supports the cooling means. The thermal head support member has a support component that supports the thermal head, and a recess provided to the back side, which is the opposite side from the support component, and is movably disposed between a transfer position where the ink is transferred and a retracted position to which the thermal head support member is retracted from the transfer position. The cooling means radiates the heat generated by the thermal head. The support member supports the cooling means such that at least part of the cooling means will enter the recess when the thermal head support member is moved to its retracted position.

Also, the printer device of the present invention comprises an arm, heat radiating means, and a setback. The arm has a heat generating component for transferring ink, rotatably disposed between a transfer position where the ink is transferred onto a recording medium and a retracted position to which the arm is retracted from the transfer position. The heat radiating means is supported so as to be located within the movement path that is defined as the arm rotates, and radiates the heat generated by the heat generating component of the arm. The setback is provided to the back of the arm so as to avoid interference between the heat radiating means and the arm when the arm has moved to the retracted position.

DESCRIPTION OF THE PREFERRED EMBODIMENTS

Embodiments of the present invention will now be described in detail through reference to the figures.

Figure 1:
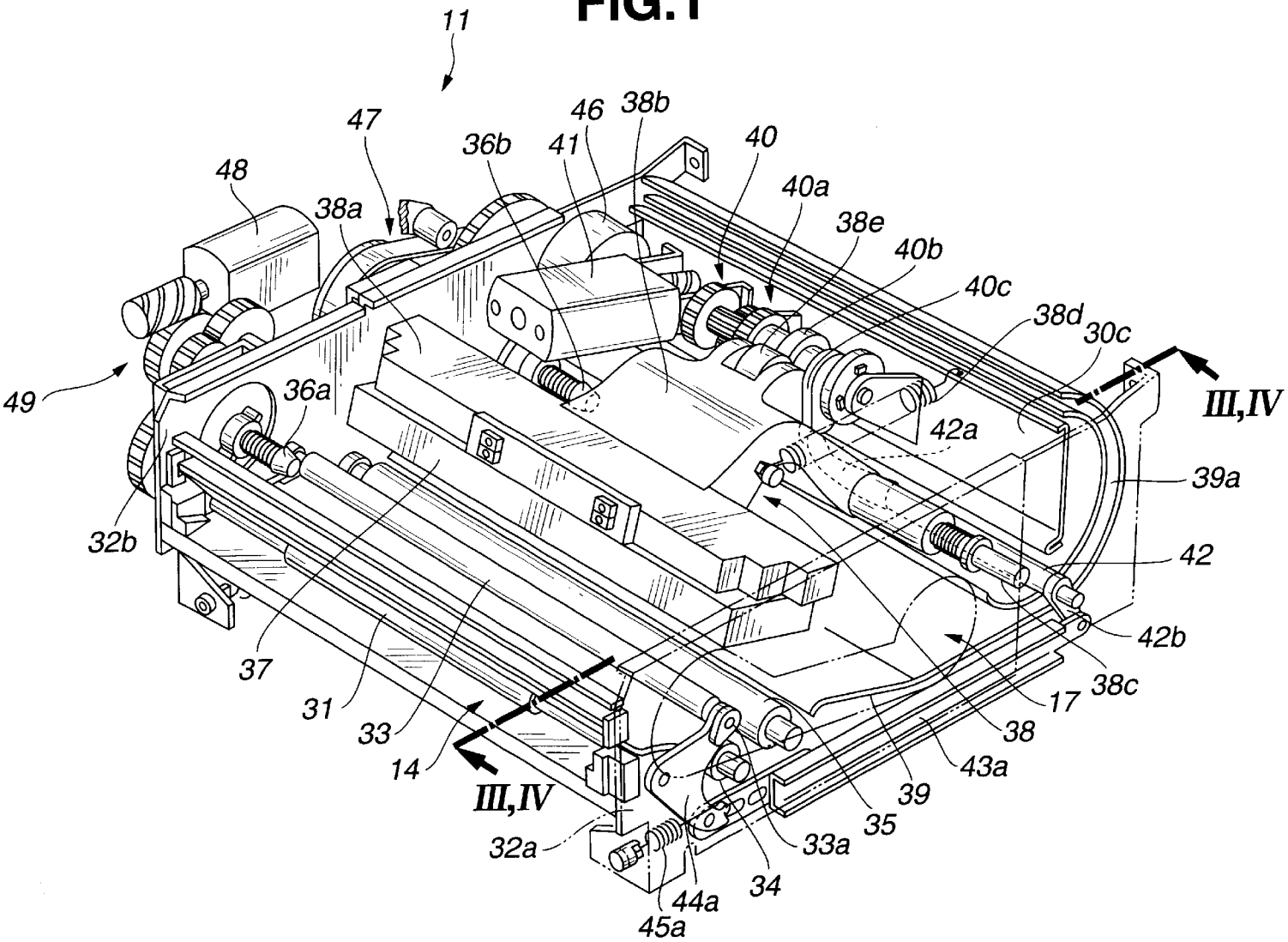
FIG. 1 is a perspective view of the internal structure of an embodiment of the printer device pertaining to the present invention.
Figure 2:
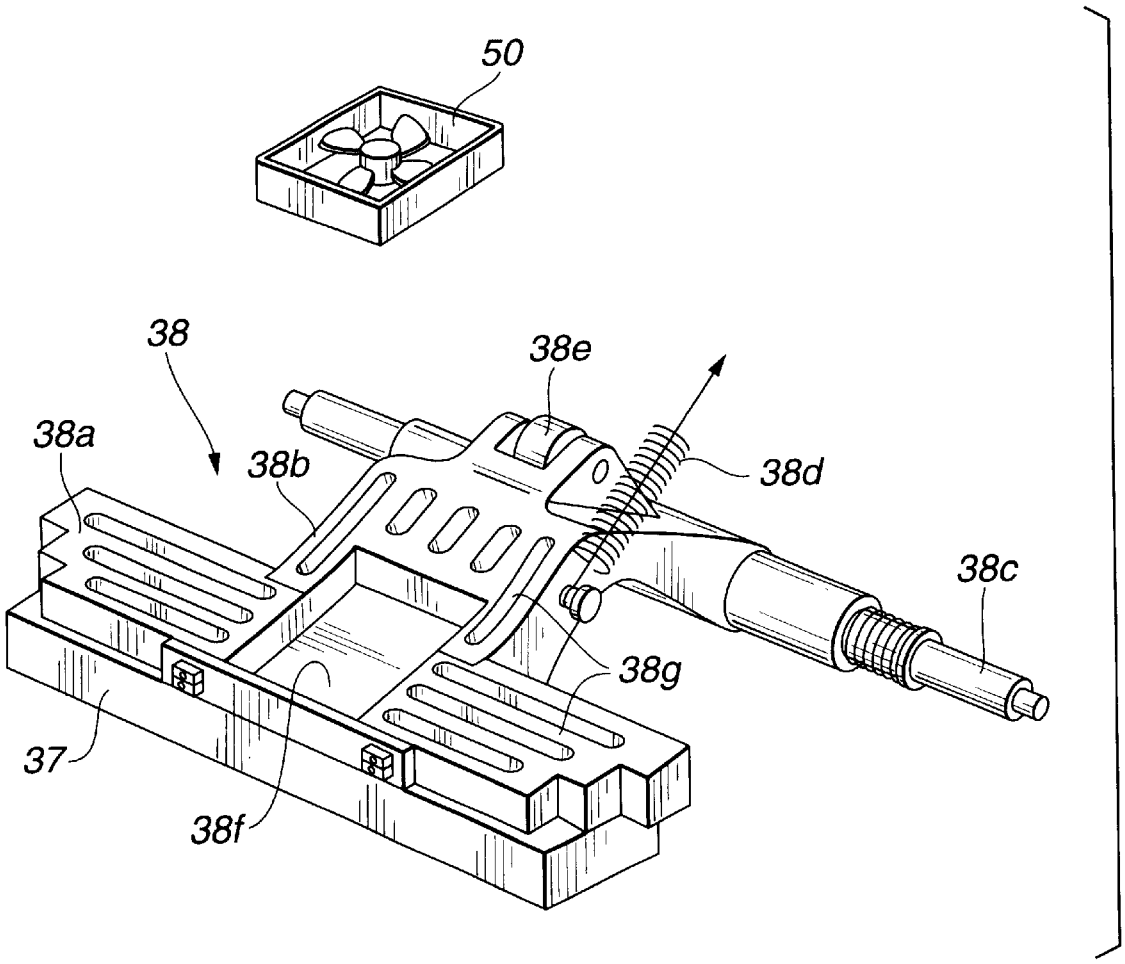
FIG. 2 is a perspective view of the relationship between the cooling fan and the thermal head support member of the printer device pertaining to the present invention.
Figure 3:
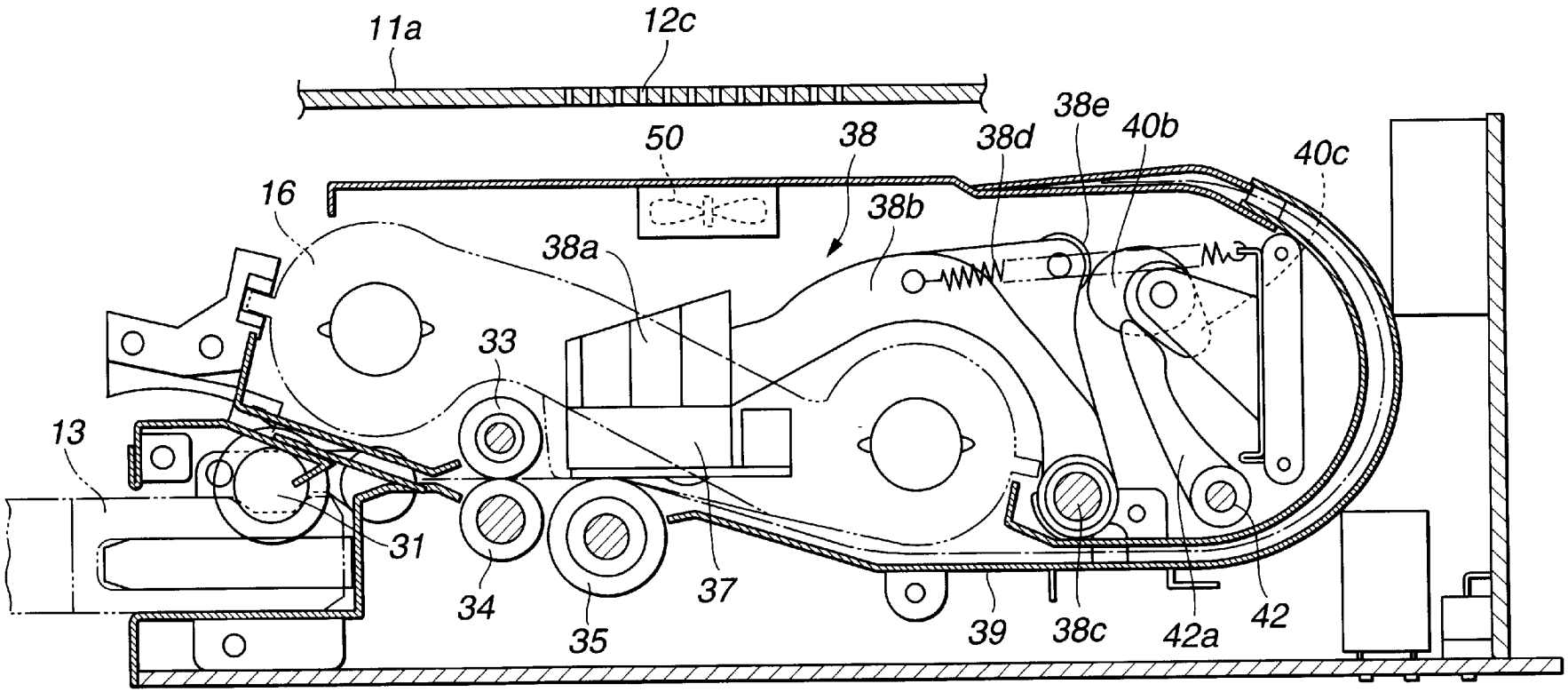
FIG. 3 is a side view illustrating the relationship between the cooling fan and the thermal head support member when the printer device pertaining to the present invention is printing.
Figure 4:
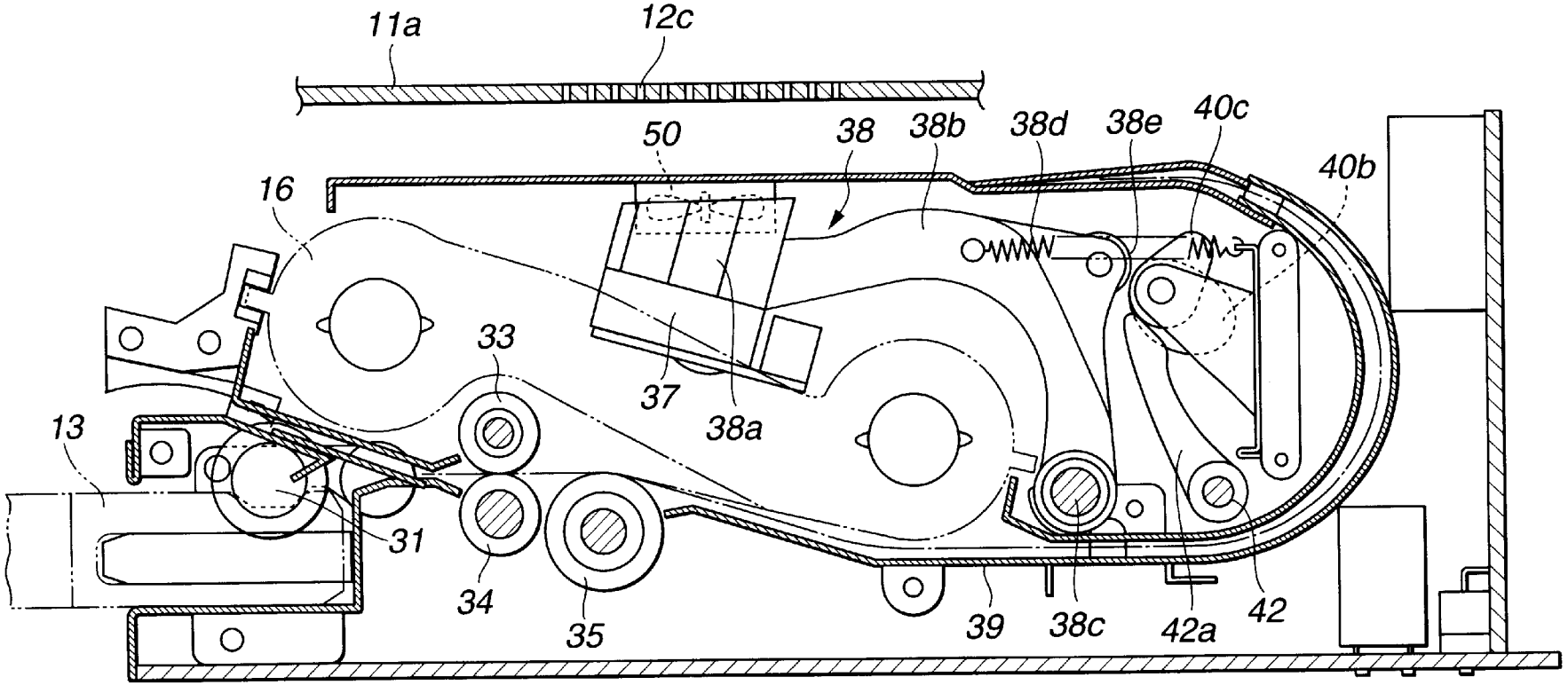
FIG. 4 is a side view illustrating the relationship between the cooling fan and the thermal head support member when the printer device pertaining to the present invention is not printing.
Figure 5:
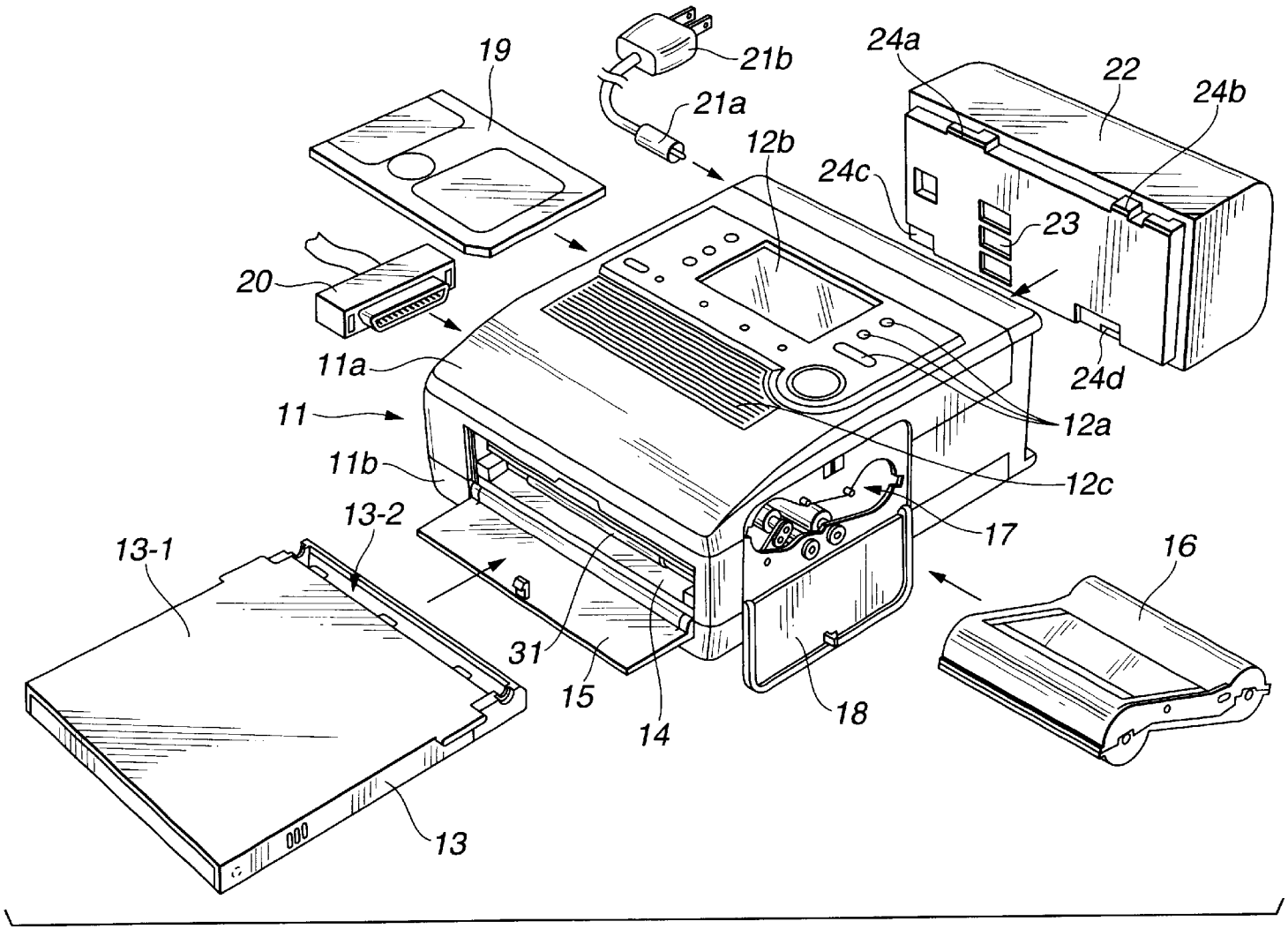
FIG. 5 is a perspective view of the external structure of the printer device pertaining to the present invention.

FIG. 1 is a perspective view of the internal structure of an embodiment of the printer device pertaining to the present invention. FIG. 2 is a perspective view of the relationship between the cooling fan and the thermal head support member of the printer device pertaining to the present invention. FIG. 3 is a side view illustrating the relationship between the cooling fan and the thermal head support member during printing with the printer device pertaining to the present invention. FIG. 4 is a side view illustrating the relationship between the cooling fan and the thermal head support member when the printer device pertaining to the present invention is not printing. FIG. 5 is a perspective view of the external structure of the printer device pertaining to the present invention.

First, the external structure of the printer device will be described through FIG. 5. In this figure, 11 is the printer device (hereinafter referred to as the device body), which has an overall shape that is substantially rectangular. The outer cover of the device body 11 is formed from a top housing 11*a* and a bottom housing 11*b*. An input switch group 12*a* for inputting various commands and a display component 12*b* for indicating the command operating status are provided to the top side of the top housing 11*a*, and a heat radiating opening 12*c* for releasing the heat produced within the device body 11 is also formed in this top side. A cooling fan (discussed below) is provided on the inside of this heat radiating opening 12*c*.

A recording paper insertion opening 14 for inserting recording paper (the recording medium) contained in a recording paper cassette 13, and which allows the installation and removal of this recording paper cassette 13, is provided to the front of the device body 11. This recording paper insertion opening 14 is covered by a recording paper insertion opening cover 15 when the recording paper cassette 13 is not installed. The recording paper cassette 13 has a compartment for holding a plurality of sheets of recording paper (not shown), and in this compartment is disposed an elastic member (not shown) that pushes the recording paper upward. The recording paper cassette 13 also has a cover member 13-1 that covers the top side of the recording paper held in the compartment, and there is provided a recording paper pull-out opening 13-2 formed by leaving off part of the cover member on the end of the recording paper cassette 13 that is inserted into the recording paper insertion opening 14 of the device body 11. When the recording paper cassette 13 is installed in the recording paper insertion opening 14, the recording paper, which is being pressed upward by the elastic member, comes into contact with a recording paper pull-out roller 31. The rotation of this recording paper pull-out roller 31 causes the recording paper to be conveyed into the device body 11 one sheet at a time.

An ink ribbon insertion opening 17 for inserting an ink ribbon cassette 16 at a specific location within the device body 11 is provided to the device body 11 on the right side in the figure. This ink ribbon insertion opening 17 is covered by an ink ribbon insertion opening cover 18. The ink ribbon cassette 16 has an ink ribbon, a supply reel holder that holds a supply reel (not shown) on which the ink ribbon has been wound, and a winding reel holder that holds a winding reel (not shown) on which the ink ribbon will be wound. The ink ribbon is produced by sequentially and repeatedly coating a thin film with thermal transfer ink coatings in a plurality of colors, such as yellow (Y), magenta (M), cyan (C), and a transparent overcoat ink (OP). Specifically, the thin film substrate is coated with a plurality of inks (Y, M, and C) in a specific order (Y, M, then C). The ink ribbon stretched out between the supply reel holder and the winding reel holder is exposed from the ink ribbon cassette 16. Furthermore, the ink ribbon cassette 16 has an opening through which the thermal head (discussed below) makes contact. The ink ribbon insertion opening 17 has substantially the same shape as the cross sectional shape of the cassette in the direction perpendicular to the insertion direction of the cassette so that the ink ribbon cassette 16 can be inserted therein. This shape is one that allows the ink ribbon cassette 16 to be easily inserted and prevents improper insertion.

On the left side in the figure, the device body 11 is provided with a storage medium insertion opening (not shown) in which a storage medium 19 is inserted, a PC interface connector (not shown) to which a PC interface plug 20 is connected, and a DC inlet connector (not shown) to which a DC inlet plug 21*a* is connected. An AC/DC converter (not shown) is provided between the DC inlet plug 21*a* and a plug 21*b* connected to an electrical outlet (not shown). The storage medium 19 is a card-style storage medium with a built-in semiconductor memory for recording and storing image data captured by a digital still picture capturing device or moving picture capturing device (not shown). The storage medium 19 is inserted into the device body 11 through the storage medium insertion opening, and the image data stored by the storage medium 19 is read out. The PC interface plug 20 is connected to a computer (not shown), and is an interface for sending the computer graphic image data produced by the computer through the PC interface connector to the device body 11. A specific DC power supply, obtained by rectifying and converting a commercial AC power supply with the AC/DC converter, is supplied by the DC inlet plug 21*a* through the DC inlet connector as a drive power supply for driving the various signal processing circuits and drive functions of the device body 11.

A battery pack 22 is installed on the back of the device body 11 in the figure. Rechargeable or non-rechargeable cells (not shown) are held inside the battery pack 22. The battery pack 22 is provided with contacts 23 connected to the cells it holds, and fixing tabs 24*a* to 24*c* for removably fixing the battery pack 22 to the back of the device body 11. The back of the device body 11 is provided with battery contacts (not shown) that come into contact with the contacts 23 of the battery pack 22, and engagement tabs (not shown) that engage with the fixing tabs 24*a* to 24*c*. This battery pack 22 supplies drive power to the various components of the device body 11 when drive power is not supplied from the DC inlet plug 21*a*.

The recording paper insertion opening cover 15 and the ink ribbon insertion opening cover 18 can be opened and closed by being connected at one end to the device body 11 by a hinge or another means providing the same function as a hinge.

Next, the internal structure of the device body 11 will be described through reference to FIG. 1. The recording paper pull-out roller 31, which is fitted into the recording paper pull-out opening 13-2 (see FIG. 5) and pulls out the recording paper one sheet at a time when the recording paper cassette 13 has been installed, is disposed at the recording paper insertion opening 14. This recording paper pull-out roller 31 is rotatably supported by left and right chassis 32*a* and 32*b*. The action of an ink ribbon/recording paper drive component 49 (discussed below) causes this recording paper pull-out roller 31 to rotate counterclockwise in the figure, which is the direction in which the recording paper is pulled out from the recording paper cassette 13 and supplied into the device body 11.

The recording paper that is pulled out of the recording paper cassette 13 by the recording paper pull-out roller 31 is guided by a paper guide member, squeezed between a pressing roller 33 (a pinch roller) and a conveyor roller 34 (a capstan roller), and conveyed into the device body 11. The conveyor roller 34 is rotatably supported by the left and right chassis 32*a* and 32*b*, and is rotationally driven in the clockwise and counterclockwise directions in the figure by a conveyor roller drive component 47. The action of a thermal head/pressing roller drive component 40 (discussed below) causes the pressing roller 33 to press on and move away from the conveyor roller 34, and to rotate along with the conveyor roller 34.

The recording paper squeezed between and conveyed by the pressing roller 33 and the conveyor roller 34 is conveyed to a platen roller 35. This platen roller 35 is rotatably supported by the left and right chassis 32*a* and 32*b*.

The ink ribbon insertion opening 17, into which the ink ribbon cassette 16 is inserted, is formed in the right chassis 32*a*. When the ink ribbon cassette 16 is inserted into the device body 11 through the ink ribbon insertion opening 17, so that the opening of the ink ribbon cassette 16 is located above the platen roller 35, the supply and winding reels in the supply reel holder and the winding reel holder of the ink ribbon cassette 16 fit onto reel shaft members 36*a* and 36*b* disposed on the left chassis 32*b*. These reel shaft members 36*a* and 36*b* are rotationally driven by the ink ribbon/recording paper drive component 49 (discussed below), so that the ink ribbon is supplied from the supply reel to the winding reel (that is, it is wound onto the winding reel).

A thermal head 37 is disposed above the platen roller 35. This thermal head 37 is disposed parallel to the longitudinal direction of the platen roller 35, and is driven toward or away from the platen roller 35 by the thermal head/pressing roller drive component 40. When the thermal head 37 is pressed against the platen roller 35, the recording paper and the ink ribbon of the ink ribbon cassette 16 are tightly squeezed between these components. When the thermal head 37 and the platen roller 35 move apart, the recording paper and ink ribbon are released, and the ink ribbon cassette 16 can be inserted into or removed from the ink ribbon insertion opening 17.

The thermal head 37 is supported by and fixed to one end of a substantially T-shaped thermal head support member 38. The thermal head support member 38 is a substantially T-shaped member comprising a thermal head support component 38*a* formed parallel to the longitudinal direction of the thermal head 37, and an arm component 38*b* in the form of a curved arm extending substantially perpendicular to the longitudinal direction from the approximate center of this thermal head support component 38*a*. A recess (not shown in FIG. 1) is formed in the approximate center of the thermal head support component 38*a*. This recess, which is described in detail in the description of FIG. 2, prevents a cooling fan 50 from interfering with the thermal head support component 38*a* when printing is not being performed, and also allows the device to be more compact. The other end of the arm component 38*b* of this thermal head support member 38 is supported by the left and right chassis 32*a* and 32*b* so that the thermal head support member 38 can rotate around a rotating shaft 38*c*. Tension is applied by the force of an elastic member 38*d* so that this thermal head support member 38 is rotated clockwise around the rotating shaft 38*c*, causing the thermal head 37 to move away from the platen roller 35. A cam component 38*e* is provided between the two ends of the arm component 38*b* of the thermal head support member 38, near the top of the curved portion. A cam 40*b* is in contact with this cam component 38*e*. The cam 40*b* is designed to push the cam 38*e* through the action of the thermal head/pressing roller drive component 40 (discussed below) so that the thermal head support member 38 moves against the tension of the elastic member 38*d* and brings the thermal head 37 into contact with the platen roller 35 around the rotating shaft 38*c*.

The recording paper is conveyed to the platen roller 35 while being squeezed between the pressing roller 33 and the conveyor roller 34, and the thermal head support member 38 is driven to bring the ink ribbon and the recording paper into contact between the thermal head 37 and the platen roller 35. In this contact state, the thermal head 37 generates heat in response to a control signal based on a print image signal from a thermal head drive circuit (not shown), and this heat results in the thermal transfer of the ink from the ink ribbon onto the recording paper. The ink ribbon from which the ink has been thermally transferred is wound onto the winding reel. The recording paper onto which the ink has been thermally transferred is guided by a recording paper guide member 39 and conveyed to the rear of the device body 11. This recording paper guide member 39 has a substantially arc-shaped component 39*a* that forms a substantially arc-shaped conveyance path to the rear of the device body 11, and is shaped so as to convey and guide the recording paper to the top (in the figure) of the device body 11.

More specifically, when the recording paper is printed, the conveyor roller 34 is rotated so that the recording paper is introduced in between the thermal head 37 and the platen roller 35. The first color (yellow (Y)) with which the ink ribbon is coated is then thermally transferred by the thermal head 37 onto the recording paper from the starting end thereof, while the recording paper is guided by the recording paper guide member 39 and printed and conveyed to the end of the recording paper. Once the printing of yellow (Y) is complete, the conveyor roller 34 is rotated backward so that the recording paper is conveyed in the discharge direction of the recording paper insertion opening 14.

Once again, the conveyor roller 34 is rotated to introduce the recording paper in between the thermal head 37 and the platen roller 35. The conveyor roller 34 is rotated to convey the recording paper from its starting end in the printing direction, and subject the recording paper to thermal transfer of the next color (magenta (M)), while the recording paper is guided and conveyed by the recording paper guide member 39. This thermal transfer is repeated for cyan (C) and the transparent overcoat ink (OP), in that order, thereby performing color printing in the three primary colors of yellow (Y), magenta (M), and cyan (C). Since the conveyance path after the recording paper has undergone thermal transfer of the various colored inks by the thermal head 37 is thus substantially arc-shaped, the depth dimension of the device body 11 can be reduced.

Also, the thermal head/pressing roller drive component 40, which drives the cam component 38*e* of the thermal head support member 38, is disposed on the inner peripheral side of the substantially arc-shaped component 39*a* of the recording paper guide member 39. This thermal head/pressing roller drive component 40 comprises a first motor 41 (a drive source), a gear group 40*a* for transmitting at reduced speed the rotational drive of this first motor 41, a cam member 40*b* as a first cam drive component, and a cam member 40*c* as a second cam drive component, which are coaxially and integrally formed. The first cam drive component 40*b* receives the rotational force transmitted at reduced speed by the gear group 40*a,* and transmits it to the cam component 38*e* of the thermal head support member 38. The second cam drive component 40*c* swings slide plates 43*a* land 43*b* (the slide plate 43*b* is not shown in the figure because it is in the back by the left chassis 32*b*) that press the pressing roller 33 onto the conveyor roller 34 or move the pressing roller 33 away from the conveyor roller 34. The thermal head/pressing roller drive component 40 is provided to a back chassis 30*c*. This back chassis 30*c* is disposed on the inner peripheral side of the substantially arc-shaped component 39*a* of the recording paper guide member 39, and is sandwiched between and fixed by the left and right chassis 32*a* and 32*b*.

The second cam drive component 40*c* of the thermal head/pressing roller drive component 40 rotationally drives a transmission component comprising a cam 42*a* provided to a rotational shaft member 42 rotatably supported by the left and right chassis 32*a* and 32*b*. Elongated fixing tabs 42*b* and 42*c* (the fixing tab 42*c* is not shown in the figure because it is in the back by the left chassis 32*b*) are fastened at one end to the ends of this rotational shaft member 42. At the other end of these fixing tabs 42*b* and 42*c,* the slide plates 43*a* and 43*b* are supported at one end by rotational pins. These slide plates 43*a* and 43*b* extend substantially parallel to the recording paper guide member 39 up to the vicinity of the conveyor roller 34. At the other end of the slide plates 43*a* and 43*b,* V-shaped drive arms 44*a* and 44*b* (the drive arm 44*b* is not shown in the figure because it is in the back by the left chassis 32*b*) are rotatably supported at one end. The center portions of these drive arms 44*a* and 44*b* are rotatably supported by the left and right chassis 32*a* and 32*b*. At the other end of the drive arms 44*a* and 44*b,* the pressing roller 33 is rotatably supported on a shaft 33*a*. An elastic force that urges the pressing roller 33 in the direction of contact with the conveyor roller 34 is applied by elastic pieces 45*a* and 45*b* (the elastic piece 45*b* is not shown in the figure because it is in the back by the left chassis 32*b)* at the support points of the slide plates 43*a* and 43*b* and the drive arms 44*a* and 44*b*. The fixing tabs 42*b* and 42*c,* the slide plates 43*a* and 43*b,* and the drive arms 44*a* and 44*b* are disposed substantially in parallel in the vicinity of the surface of the left and right chassis 32*a* and 32*b*.

Specifically, the cam 42*a* is rotationally driven by the rotational drive of the second cam component 40*c* of the thermal head/pressing roller drive component 40. This rotational drive is transmitted through the rotational shaft member 42 by a link mechanism comprising the fixing tabs 42*b* and 42*c,* the slide plates 43*a* and 43*b,* and the drive arms 44*a* and 44*b,* and the pressing roller 33 moves between a position where the recording paper is held between the pressing roller 33 and the conveyor roller 34, and a position where the pressing roller 33 is away from the conveyor roller 34.

The cooling fan 50, disposed on an upper chassis (not shown), is provided above (in the figure) the thermal head support component 38*a* of the thermal head support member 38.

A first circuit board (not shown) is disposed between the conveyor roller 34, the pressing roller 33, and the recording paper guide member 39 and the bottom housing 11*b* of the device body 11. A second circuit board is disposed between the housing at the back of the device body 11 and the substantially arc-shaped component 39*a* of the recording paper guide member 39. On the first circuit board are mounted primarily a circuit for processing the image signals supplied to the thermal head 37, a circuit for reading and processing the image data and the insertion hold function of the storage medium 19, a circuit for processing image data from a computer via the PC interface connector to which the PC interface plug 20 is connected, and so forth. Battery contacts to which the contacts 23 of the battery pack 22 are connected, a connector to which the DC inlet plug 21*a* is connected, and the like are primarily disposed on the second circuit board. Also mounted on the second circuit board is a power supply circuit for supplying drive power to the various drive components, and drive power for the various circuits on the first circuit board, on the basis of the supplied power. The circuits mounted on the first and second circuit boards are not limited to those mentioned above, and the mounted circuits can be varied as necessary.

Next, a second motor 46 that drives the conveyor roller 34 on the inside of the substantially arc-shaped component 39*a* of the recording paper guide member 39 is provided to the left side (in the figure) of the device body 11. The drive shaft of this second motor 46 passes through the left chassis 32*b*. The rotating speed of the motor 46 is reduced to the desired speed by the conveyor roller drive component 47, comprising a belt and a plurality of gears, including the gears attached to the above-mentioned drive shaft. The rotational drive force that has thus been reduced to the desired speed rotationally drives the conveyor roller 34 through a gear fixed to the shaft of the conveyor roller 34.

A third motor 48 is disposed on the outside of the left chassis 32*b*. An ink ribbon/recording paper pull-out drive component 49 that rotationally drives the recording paper pull-out roller 31 and the reel shafts 36*a* and 36*b* is formed by this third motor 48 and the gear attached to the rotational shaft of the motor 48 and the plurality of other gears in the group. This ink ribbon/recording paper pull-out drive component 49 drives at a specific rotational speed the supply reel and winding reel inside the supply reel holder and winding reel holder of the ink ribbon cassette 16 fitted onto the reel shafts 36*a* and 36*b*. This drive causes the ink ribbon to be conveyed from the supply reel to the winding reel. Furthermore, the ink ribbon/recording paper pull-out drive component 49 rotationally drives the recording paper pull-out roller 31 at a specific speed, the result being that the recording paper is pulled out from the recording paper cassette 13 installed in the recording paper insertion opening 14, and the recording paper is conveyed between the pressing roller 33 and the conveyor roller 34.

Next, the detailed structure of the thermal head support member 38 in the form of a curved arm will be described through reference to FIG. 2. The thermal head 37 is supported and fixed at one end of the thermal head support member 38. The thermal head support member 38 is provided with a recess 38*f* in the center part of the back (i.e., the top in the figure), which is the opposite side from the side where the thermal head 37 is, of the thermal head support component 38*a* and the arm component 38*b*. More specifically, this recess 38*f* is provided on the back, opposite the side of the thermal head support component 38*a* where the thermal head 37 is attached, and at a position substantially facing the thermal head 37. This recess 38*f* is further provided on the upper side of the thermal head support component 38*a* (the side opposite the side where the thermal head is provided), in the approximate center in the longitudinal direction of the thermal head 37. This recess 38*f* has a shape and size that accommodate part of the outer frame of the cooling fan 50. A plurality of cooling fins 38*g* are provided to the top side of the arm component 38*b* and to the left and right top sides of the recess 38*f* of the thermal head support component 38*a*. The cooling fan 50 is disposed above the recess 38*f* along the rotational path of the thermal head support member 38. This thermal head support member 38 is made from a metal material with excellent thermal conductivity. After the heat generating element of the thermal head 37 is actuated to generate heat and thermally transfer the ink coating from the ink ribbon onto the recording paper, any residual heat in the thermal head 37 is conducted to the thermal head support member 38 and radiated into the atmosphere. The recess 38*f* and the cooling fins 38*g* allow a greater proportion of the surface area of the thermal head support component 38*a* and the arm component 38*b* to be in contact with the atmosphere, which improves the heat radiation efficiency.

Meanwhile, the cooling fan 50 disposed above the recess 38*f* provided to the thermal head support member 38 serves to release the heated atmosphere from the thermal head 37 and the thermal head support member 38 to outside the device body 11, and is disposed on the inside of the heat radiating opening 12*c* (see FIG. 5) of the device body 11.

More specifically, the accumulated heat in the thermal head 37 after the thermal transfer of ink is conducted to the thermal head support component 38*a* and the arm component 38*b*, and is radiated into the air from the surface of the thermal head support component 38*a* and the arm component 38*b*. The air thereby heated is exhausted to the outside from the heat radiating opening 12*c*. The cooling fan 50 is designed to enter the recess 38*f* of the thermal head support member 38 when the rotational drive of the thermal head/pressing roller drive component 40 moves the thermal head 37 away from the platen roller 35.

Next, the relationship between the cooling fan 50 and the movement of the thermal head support member 38 toward and away from the platen roller 35 by the thermal head/pressing roller drive component 40 will be described through reference to FIGS. 3 and 4. FIGS. 3 and 4 are side views in the direction indicated by the arrow in FIG. 1, which is sectioned along the thick one-dotted broken line.

First, the operation of bringing the thermal head 37 into contact with the platen roller 35 will be described through reference to FIG. 3. The drive rotation of the first motor 41 is transmitted through the gear group 40*a* to the first cam component 40*b*, causing the first cam component 40*b* to rotate counterclockwise in the figure and press on the cam component 38*e* of the thermal head support member 38. The cam component 38*e* is formed between the rotating shaft 38*c* at one end of the thermal head support member 38 and the thermal head support component 38*a* at the other end. The cam component 38*e* is a driven component, and is driven in its cam motion by the first cam component 40*b*, which is a driving member. The thermal head support member 38 rotates clockwise in the figure around the rotating shaft 38*c* and against the force of the elastic member 38*d*, bringing the thermal head 37 into contact with the platen roller 35.

As a result, the ink ribbon and recording paper are squeezed between the thermal head 37 and the platen roller 35, heat is generated according to control signals based on image data supplied to the thermal head 37, and the thermal transfer of the ink from the ink ribbon is performed.

Next, the operation of moving the thermal head 37 away from the platen roller 35 will be described through reference to FIG. 4. When the first motor 41 is rotationally driven backward, the rotational drive thereof is transmitted through the gear group 40*a* to the first cam component 40*b*, the first cam component 40*b* rotates clockwise in the figure, and the thermal head support member 38 is released from the press contact with the cam component 38*e*. The thermal head support member 38 is rotated clockwise in the figure around the rotating shaft 38*c* by the force of the elastic member 38*d*, moving the thermal head 37 away from the platen roller 35 and causing the cooling fan 50 to enter the recess 38*f* on the top side of the thermal head support member 38. The cooling fan 50 is supported and fixed by the recording paper guide member 39. When the cam 40*b* stops rotating, the cooling fan 50 comes to a stop in a retracted position in which it has entered the recess. Put another way, the recess provided in the back of the arm component 38*b* serves as a setback so that the cooling fan 50 (heat radiating means) will not interfere with the arm component 38*b* that has moved to the retracted position.

More specifically, because the cooling fan 50 is located within the path of movement of the recess 38*f* when the thermal head support member 38 has been rotated around the rotating shaft 38*c* to the retracted position away from the transfer position where it was in contact with the platen roller 35, at least part of the cooling fan 50 enters the recess 38*f* provided on the back side of the thermal head support component 38*a*, opposite the side where the thermal head 37 is attached. Therefore, the space between the thermal head support member 38 and the cooling fan 50 can be reduced, which makes possible a reduction in the height of the device body 11 and makes it possible to obtain a thinner device body.

As described above, the printer device of the present invention is such that a recess which part of the cooling fan 50 enters is provided to the back side of the thermal head support component 38*a*, which is the opposite side from where the thermal head 37 is attached, the result of which is that sufficient stroke is ensured for moving the thermal head support member 38 toward and away from the platen roller 35, and the height of the device body 11 can also be reduced.

In other words, with the printer device of the present invention, part of the cooling fan enters the recess provided to the thermal head support member when the thermal head support member moves away from the platen roller, which affords enough space for the rotational stroke of the thermal head support member while allowing the device body to be thinner. Another benefit is that thermal radiation characteristics are enhanced because of the greater heat radiation surface area afforded by the recess provided in the thermal head support member. The present invention is particularly effective in making a thinner and more compact portable printer device.

What is claimed is:

1. A printer device that makes use of a thermal head to transfer ink to a recording medium on a platen roller, comprising:

a thermal head support member having a support component that supports the thermal head, and a recess provided to a back side, which is on an opposite side from the support component, said thermal head support member being arranged so as to be movable between a transfer position where the ink is transferred and a retracted position to which the thermal head support member is retracted from the transfer position;

cooling means for radiating the heat generated by the thermal head; and a support member for supporting the cooling means such that at least part of the cooling means will enter the recess when the thermal head support member is moved to its retracted position.

2. The printer device according to claim 1, wherein the cooling means is a fan that expels the heat to outside of the printer device.

3. The printer device according to claim 1 wherein the recess provided on the back side of the thermal head support member is disposed at a position substantially facing the thermal head.

4. The printer device according to claim 3, wherein the recess provided on the back side of the thermal head support member is disposed substantially at the center of the thermal head in its longitudinal direction.

5. The printer device according to claim 3, wherein the thermal head support member is rotatable between the transfer position and the retracted position.

6. The printer device according to claim 5, wherein the cooling means is fixed to the support member as to be located within the movement path of the recess that is defined as the thermal head support member rotates.

7. The printer device according to claim 6, wherein the thermal head support member is a curved arm, with the thermal head disposed at one end, and the other end being rotatably supported.

8. The printer device according to claim 7, wherein a driven component is formed between the one and the other ends, and said driven component is a cam driven by a drive member provided to the printer device.

9. The printer device according to claim 1, wherein the support member is part of a recording paper guide member constituting a path over which the recording paper is conveyed.

10. A printer device, comprising:

an arm having a heat generating component for transferring ink, rotatably disposed between a transfer position where the ink is transferred onto a recording medium and a retracted position to which the arm is retracted from the transfer position;

heat radiating means supported so as to be located within a movement path that is defined as the arm rotates, for radiating the heat generated by a heat generating component of the arm; and a setback provided to a back of the arm so as to avoid interference between the heat radiating means and the arm when the arm has moved to the retracted position.

11. The printer device according to claim 10, wherein the setback is provided on an opposite side of the arm from the side where the heat generating component is provided.

12. The printer device according to claim 11, wherein the setback is a recess that is concaved into an inside of the arm.

13. The printer device according to claim 10, wherein the setback is provided to the back of the arm substantially facing the heat generating component provided to the arm.

14. The printer device according to claim 10, wherein the heat radiating means is a fan that expels the heat to outside of the device, and the heat generating component is a thermal head.

15. The printer device according to claim 10, wherein the heat generating component is a thermal head, and the setback is provided to the back of the arm substantially corresponding to a center of the thermal head in its longitudinal direction.

* * * * *